US005989735A

United States Patent [19]

Ruimi et al.

[11] Patent Number: 5,989,735

[45] Date of Patent: Nov. 23, 1999

[54] PROTECTIVE COATING FOR METAL COMPONENTS PROVIDING GOOD CORROSION RESISTANCE IN A SALINE ATMOSPHERE, AND METHOD OF PRODUCING SAID COATING

[75] Inventors: Michel Ruimi, Paris; Jean-Paul Guerbert-Jubert, Lexy, both of France

[73] Assignee: Societe Nationale d'Etude et de Construction de Moteurs d'Aviation "SNECMA", Paris, France

[21] Appl. No.: 09/080,238

[22] Filed: May 18, 1998

[30] Foreign Application Priority Data

May 22, 1997 [FR] France ..... 97 06232

[51] Int. Cl.[6] ..... B32B 15/04; C25D 5/12

[52] U.S. Cl. ..... 428/658; 428/659; 428/646; 428/632; 428/933; 205/171; 205/252

[58] Field of Search ..... 428/658, 659, 428/646, 632, 933; 205/171, 183, 184, 191, 252

[56] References Cited

U.S. PATENT DOCUMENTS 2,675,347 4/1954 Lowenheim .
4,999,258 3/1991 Wake et al. .
5,059,493 10/1991 Takahata .
5,275,892 1/1994 Hyner et al. .
5,378,346 1/1995 Ashiru et al. .
5,491,035 2/1996 Carey, II et al. .

FOREIGN PATENT DOCUMENTS 5-33188 2/1993 Japan .

*Primary Examiner*—Deborah Jones
*Assistant Examiner*—Jason Savage
*Attorney, Agent, or Firm*—Oblon, Spivak, McClelland, Maier & Neustadt, P.C.

[57] ABSTRACT

A coating for protecting metal components against corrosion in a saline atmosphere comprises at least one layer of a tin/zinc alloy containing between 8% and 35% by weight of zinc deposited on a sublayer of an alloy of zinc/nickel containing between 10% and 16% by weight of nickel, the thickness proportion of the two alloys forming the coating being two-thirds in the case of the zinc/nickel alloy and one-third in the case of the tin/zinc alloy. The coating may also include an external chromate film.

9 Claims, 1 Drawing Sheet

| Material/coating | Pdd(mV)/SCE t=0 min | Pdd(mV)/SCE t = 5 min | Galvanic coupling (mV) |
|---|---|---|---|
| XES | -370 | -430 | 0 |
| XES + Cd | -740 | -730 | 130 |
| XES + Cd + fc | -770 | -780 | 80 |
| XES + Sn/Zn (12 to 25% Zn) | -940 | -930 | 70 |
| XES + Sn/Zn (12 to 25% Zn) + fc | -890 | -870 | 10 |
| 15CDV6 (sand-blasted) | -495 | -530 | 0 |
| 15CDV6 + Zn/Ni (10 to 15% Ni) + fc | -860 | -910 | 150 |

fc: chromic finish

Fig: 1

| Nature of the substance | Base | % C | % Cr | % Mo | % V | Structure |
|---|---|---|---|---|---|---|
| XES steel | iron | 0.08 | | | | ferritic |
| 15CDV6 steel | iron | 0.15 | 1.35 | 0.90 | 0.25 | martensitic |

Fig: 2

| Nature of the coating | Galvanic coupling with the steel substrate | Salt-fog behavior (after 330 h) | Alternating-cycling behavior after 8 cycles) |
|---|---|---|---|
| Cadmium | good | excellent | excellent |
| Zinc/Nickel (10-16% Ni) | good | good | average |
| Tin/Zinc (12-15% Zn) | excellent | good | average |
| "sandwich" | | good | good |

Fig: 3

PROTECTIVE COATING FOR METAL COMPONENTS PROVIDING GOOD CORROSION RESISTANCE IN A SALINE ATMOSPHERE, AND METHOD OF PRODUCING SAID COATING

BACKGROUND OF THE INVENTION

1. Field of the Invention

The invention relates to a protective coating for a metal component, said coating having good corrosion resistance in a saline atmosphere, to a method of forming such a coating, and to metal components having said coating. The invention is applicable in particular to the protection of steel aeronautical components, such as the components of aircraft engines, which require a high degree of reliability, and to the protection of aluminum-alloy components precoated with a chemical zincate sublayer.

2. Summary of the Prior Art

To protect steel components from saline corrosion, it is known to use cadmium, deposited electrolytically, as a protective anodic coating. This coating can be used hot, up to temperatures of about 235° C.

Although cadmium provides metal components with good corrosion protection, it does have a high degree of toxicity and exhibits intrinsic incompatibilities when used with some materials. In particular, cadmium possesses a risk of intergranular corrosion, with the formation of cracks, when in contact with titanium and its alloys, and unfavorable catalytic action when in contact with synthetic oils and with fuels.

Various types of coatings have been proposed to replace cadmium. In particular, zinc-nickel coatings containing from 6% to 8% of nickel and produced in a noncyanide-containing alkaline medium have proved beneficial, since they provide good resistance to saline corrosion, but their behavior in alternating cycling is poor.

It is also known that, in the connector field, tin-nickel coatings containing 35% of nickel and deposited on a copper sublayer provide good corrosion-resistance properties. However, this type of coating does not behave in a sacrificial manner with respect to steel substrates, thereby limiting its lifetime under harsh conditions, such as alternating cycling.

SUMMARY OF THE INVENTION

The object of the invention is to provide a protective coating for a metal component which does not contain cadmium, which provides effective anodic protection against corrosion in a saline atmosphere and in alternating cycling, and which has a low sensitivity to galvanic corrosion. To this end, the invention provides a protective coating for a metal component, said protective coating having good corrosion resistance in a saline atmosphere and comprising at least one layer of a tin/zinc alloy containing between 8% and 35% by weight of zinc, and a sublayer of a zinc/nickel alloy containing between 10% and 16% by weight of nickel, said sublayer of zinc/nickel alloy lying between said metal component and said at least one layer of tin/zinc alloy and constituting about two thirds of the thickness of said coating, said at least one layer of tin/zinc alloy constituting about one third of the thickness of said coating.

Preferably, the tin/zinc alloy contains between 12% and 25% by weight of zinc.

Advantageously, the coating further comprises an external chromate film.

Preferably, the layer or layers of the tin/zinc alloy and/or the sublayer of the zinc/nickel alloy are deposited by electrolysis, preferably using plating solutions which contain no added agent of the brightener type, whether organic or metallic.

Other preferred features and advantages of the invention will become apparent from the following description of the preferred embodiments and examples, and with reference to the appended figures.

BRIEF DESCRIPTION OF THE FIGURES

FIG. 1 is a comparative table indicating the values of dissolution potentials and the values of the galvanic coupling of different types of coatings on steel substrates;

FIG. 2 is a table indicating the composition and structure of the of two types of steels considered in FIG. 1; and FIG. 3 is a comparative table summarizing the results obtained from tests on the behavior of different types of coatings in the presence of salt-fog and in alternating cycling.

DETAILED DESCRIPTION OF THE INVENTION AND PREFERRED EMBODIMENTS

To form an effective coating for protecting metal components against saline corrosion, the coating must behave anodically with respect to the metal substrate, that is to say it must exhibit sacrificial behavior with respect to the substrate. Moreover, the galvanic coupling between the coating and the substrate must be low, in order to decrease the risk of the coating being sensitive to galvanic corrosion and to increase its working life.

After having carried out a comparative study of the properties of various types of binary coatings compared with an electroplated cadmium coating, we have found that a binary electroplated coating consisting of a tin/zinc alloy containing between 8 and 35% by weight of zinc, and preferably between 12 and 25% by weight of zinc, behaves satisfactorily in a saline-corrosion situation, even under harsh alternating cycling conditions, and has a low galvanic coupling with a metal substrate.

The electroplated tin/zinc coating may be used alone and deposited directly on the metal substrate, but it is preferred to use it in a sandwich-type coating in which it is deposited on a sublayer of a zinc-nickel alloy containing from 10% to 16% by weight of nickel. The zinc/nickel alloy is preferably deposited electrolytically on the metal substrate, and the thickness proportion of the two alloys in the sandwich coating is preferably ⅔ Zn—Ni and ⅓ Sn—Zn. The sandwich coating provides twofold protection of metal components against saline corrosion and it increases the corrosion resistance by decreasing the galvanic coupling of the coating with respect to the metal substrate. The zinc/nickel alloy is preferably used as the sublayer in order to improve the adhesion of the coating to the metal component.

The tin/zinc or sandwich-type coating may also include an external chromate film, which serves to further improve the saline-corrosion behavior of the coating. The tin/zinc alloy and/or the zinc/nickel alloy are preferably electrolytically deposited using plating solutions which contain no added agent of the brightener type, whether organic or metallic, as such agents cause hydrogen embrittlement.

The electroplated tin/zinc coating may be deposited using a solution having the following composition:

sodium stannate: from 30 to 75 g/l and preferably 67 g/l;

zinc cyanide: from 2 to 10 g/l and preferably 5.4 g/l;

sodium hydroxide: from 2 to 10 g/l and preferably 5 g/l;

sodium cyanide: from 15 to 45 g/l and preferably 28 g/l.

The temperature range of the plating solution is preferably between 63 and 67° C., the range of cathode current densities applied during the electrolysis is preferably between 1 and 3 A/dm$^2$, and the range of voltages applied is preferably between 2 and 5 V. The anodes used are preferably tin/zinc alloyed anodes containing, for example, 75% by weight of tin and 25% by weight of zinc.

It is also possible to use two tin anodes and two zinc anodes alternately, taking into account the fact that the zinc anodes dissolve more quickly than the tin anodes, thereby causing the solution to be gradually enriched with zinc.

The composition of the plating solution may be different. In particular, for health and safety reasons, the cyanide complexant may be replaced by a noncyanide nitrogen-containing alkaline complexant containing, for example, one or more amine functional groups and/or one or more amide functional groups.

The electroplated zinc/nickel coating (10% to 16% by weight of nickel) may be deposited using a plating solution known commercially by the name Slotoloy ZN50.

The composition of this solution is as follows:

| | |
|---|---|
| sodium hydroxide | 12.5 g/l |
| zinc | 7.5 g/l |
| nickel | 1.3 g/l |
| ZN51 | 40 ml/l |
| ZN52 | 75 ml/l |
| ZN53 | 5 ml/1 |

The additive known commercially as ZN51 is a complexant containing amines, and the additives known commercially as ZN52 and ZN53 are grain refiners. The zinc is introduced in the form of zinc oxide (ZnO), and the nickel is introduced in the form of $NiSO_4.6H_2O$. The anodes used are nickel anodes. The plating solution temperature during operation is preferably between 63 and 67° C., the range of cathode current densities applied during the electrolysis is preferably between 1 and 3 A/dm$^2$, and the range of voltage applied is preferably between 3 and 6 V.

FIG. 1 shows a comparative table giving initial dissolution potentials, the dissolution potentials measured after a time t equal to 5 minutes, and the values of galvanic coupling for various types of coatings formed on two different steel substrates having compositions as indicated in FIG. 2.

Measuring the electrochemical dissolution potentials (denoted by pdd) makes it possible to assess the risk of a coating being sensitive to galvanic corrosion between the coating and the substrate on which it is deposited. In particular, galvanic coupling values greater than 250 mV in a wet environment are liable to cause galvanic corrosion, this being manifested by preferential corrosion of the coating if the latter behaves sacrificially with respect to the substrate on which it is deposited. The electrochemical dissolution potentials for the materials or coatings indicated in the table of FIG. 1 are measured by means of an electronic multimeasurement device, using a saturated calomel reference electrode (denoted SCE).

The electrolyte employed is a solution containing 30 g/l of sodium chloride, 1.284 g/l of sodium hydrogen phosphate and 0.187 g/l of boric acid. The pH of the plating solution is maintained at 8±0.1 and the measurements are performed at room temperature.

The electrochemical dissolution potentials are measured at time t=0 (instantaneous measurement) and at the end of 5 minutes after the plating solution has stabilized, for two different types of steel, known by their commercial names XES steel and 15CDV6 steel, respectively, and for various types of coating deposited on these steels.

The coatings are a cadmium coating deposited on an XES steel substrate, a first coating being without a chromic finish and a second being with a chromic finish; a coating of a tin/zinc alloy containing from 8% to 35% by weight of zinc deposited on an XES steel substrate, one coating being without a chromic finish and another with a chromic finish; and a coating of a zinc/nickel alloy containing from 10% to 16% by weight of nickel deposited on a 15CDV6 steel substrate and having a chromic finish. The cadmium coating is used as reference. The measured electrochemical dissolution potentials show that all the coatings exhibit sacrificial behavior, the steel substrate provided with any of the coatings being more anodic than the steel alone.

Moreover, the low value of galvanic coupling between the XES steel and a tin/zinc alloy coating containing from 8% to 35% of zinc presages a long lifetime for this type of coating.

FIG. 1 also shows that depositing a chromate film, referred to as a chromic finish, on the protective coating is particularly advantageous as it appreciably decreases the galvanic coupling between the steel substrate and the coating and thus considerably increases the lifetime of the coating.

Tests on the behavior of the coatings in the presence of salt-fog and in alternating cycling were carried out for all the coatings given in FIG. 1, as well as on an additional coating, called a sandwich coating, comprising a first layer consisting of an electroplated coating of a zinc/nickel alloy containing from 10% to 16% by weight of nickel and a second layer consisting of an electroplated coating of a tin/zinc alloy containing from 8% to 35% by weight of zinc.

The thicknesses of all the coatings were between 10 and 15 $\mu$m.

The results obtained in these tests are summarized in the comparative table forming FIG. 3. The tests on the saline-corrosion behavior were carried out in accordance with the AFNOR NFX4/0.002 standard, i.e. by exposing the coatings in a fog containing 5% sodium chloride, having a pH of 7±0.1, and a temperature of 35°±2° C. The exposure time is 336 hours.

With or without a chromic finish, the cadmium coatings exhibit excellent behavior in the presence of salt-fog. After 336 hours of exposure, no corrosion spot on the steel substrate was observed, confirming the protective effect of this coating with respect to steel.

The electroplated coating of a zinc/nickel alloy containing from 10% to 16% by weight of nickel and the electroplated coatings of a tin/zinc alloy containing from 8% to 35% by weight of zinc behave similarly in the presence of salt-fog. After 216 hours of exposure to salt-fog, fine streaks of white corrosion appear, but these do not change over time. After 336 hours of exposure to salt-fog, no corrosion of the steel substrate was observed.

With regard to the Zn/Ni (10 to 16% by weight of Ni)+Sn/Zn (8 to 35% by weight of Zn) sandwich coating, fine streaks of white corrosion are observed after 192 hours of exposure to salt-fog, but these effects are insignificant and up to an exposure time of 336 hours they do not change. No corrosion spots on the steel substrate is observed.

Consequently, the Zn/Ni (10 to 16% by weight of Ni), Sn/Zn (8 to 35% by weight of Zn) and ⅔ Zn/Ni (10 to 16% by weight of Ni)+⅓ Sn/Zn (8 to 35% by weight of Zn) sandwich coatings exhibit very similar saline-corrosion behavior up to 336 hours of exposure to salt-fog.

The results obtained after exposure to salt-fog are different from the corrosion observed during exposure to the terrestrial atmosphere. This is due to the cyclic variations in the climatic conditions and in particular to the cyclic variations in humidity, temperature and exposure to sunlight.

Alternating cycling tests were therefore carried out to assess the behavior in these conditions of all the coatings given in FIG. 1, as well as for the ⅔ Zn/Ni (10 to 16% by weight of Ni)+⅓ Sn/Zn (8 to 35% by weight of Zn) sandwich coating.

Each cycle consists of exposing a given material to a salt-fog at a temperature of 35° C. for 15 hours and then heating the material to a predetermined high temperature for 6 hours. The high temperature is chosen to be less than the melting point of the various elements of the coating.

For the coatings which do not contain tin, the high temperature is chosen to be 235° C.; for the coating containing a tin/zinc alloy and for the sandwich coating, the high temperature is chosen to be 150° C. because of the low melting point of tin.

With regard to the cadmium coating, no corrosion of the steel substrate is observed after eight test cycles, and the behavior of this coating is excellent.

With regard to the electroplated coating of a zinc/nickel alloy containing from 10% to 16% by weight of nickel, after four test cycles the white corrosion occupies 50% of the surface of the coating. By the fifth test cycle, the white corrosion has progressed and extends over the entire surface of the coating. Corrosion spots on the steel substrate appear by the sixth test cycle.

The alternating-cycling behavior of the electroplated coating of a tin/zinc alloy containing from 8% to 35% by weight of zinc is similar to the behavior of the electroplated coating of the zinc/nickel alloy. By the sixth test cycle, 15 to 20% of the surface of the steel substrate is attacked by the white corrosion.

The behavior of the sandwich coating in alternating cycling is markedly superior. No white corrosion is observed after eight test cycles. However, a few corrosion pits, approximately 0.5 $mm^2$ in size, appear on the surface after eight test cycles.

Consequently, compared with the zinc/nickel and tin/zinc coatings, the sandwich coating behaves best against saline corrosion and under alternating cycling conditions, and provides effective protection against the corrosion of a steel component when the latter is used under harsh conditions.

The zinc/nickel and tin/zinc coatings may be used as coatings for protecting steel components in cases where the conditions of use of the components are less harsh. The zinc/nickel and tin/zinc coatings may also be deposited on metal components other than steel components, such as, for example, aluminum-alloy components precoated with a chemical zincate sublayer.

It will be understood that the invention is not limited to the specific embodiments described above. In particular, whereas depositing the coating alloys electrolytically is advantageous from the standpoint of the cost of deposition and also allows the concentration of the alloy elements to be simply controlled by the choice of cathode current density applied during the electrolysis and by the choice of voltage applied, the alloys in question may also be deposited by any other known method.

We claim:

1. A protective coating for a metal component, said protective coating having good corrosion resistance in a saline atmosphere and comprising at least one layer of a tin/zinc alloy containing between 8% and 35% by weight of zinc, and a sublayer of a zinc/nickel alloy containing between 10% and 16% by weight of nickel, said sublayer of zinc/nickel alloy lying between said metal component and said at least one layer of tin/zinc alloy and constituting about two thirds of the thickness of said coating, said at least one layer of tin/zinc alloy constituting about one third of the thickness of said coating.

2. The protective coating as claimed in claim 1, wherein said at least one layer of tin/zinc alloy contains between 12% and 25% by weight of zinc.

3. The protective coating as claimed in claim 1, further comprising an external chromate film over said at least one layer of tin/zinc alloy.

4. A method of forming a protective coating on a metal component, said protective coating having good corrosion resistance in a saline atmosphere, said method comprising the steps of:

depositing on said metal component a sub-layer of a zinc/nickel alloy containing between 10% and 16% by weight of nickel; and depositing on said sub-layer at least one layer of a tin/zinc alloy containing between 8% and 35% by weight of zinc;

whereby said sub-layer of zinc/nickel alloy constitutes about two thirds of the thickness of said coating and said at least one layer of tin/zinc alloy constitutes about one third of the thickness of said coating;

and wherein at least one of said sub-layer of zinc/nickel alloy and said at least one layer of tin/zinc alloy is deposited by electrolysis.

5. The method as claimed in claim 4, wherein said sub-layer of zinc/nickel alloy and said at least one layer of tin/zinc alloy are each deposited electrolytically using a plating solution which contains no added agent of the brightener type.

6. The method as claimed in claim 4, wherein said at least one layer of tin/zinc alloy is deposited electrolytically using a plating solution having the following composition:

| | |
|---|---|
| sodium stannate | 67 g/l |
| zinc cyanide | 5.4 g/l |
| sodium hydroxide | 5 g/l |
| sodium cyanide | 28 g/l. |

7. The method as claimed in claim 6, wherein the cyanide complexant, used in the zinc cyanide and the sodium cyanide of said plating solution, is replaced by a noncyanide nitrogen-containing alkaline complexant.

8. The method as claimed in claim 4, wherein said at least one layer of tin/zinc alloy is deposited electrolytically using tin/zinc alloyed anodes.

9. A metal component having a coating for protection against corrosion in a saline atmosphere, said coating comprising a sub-layer of a zinc/nickel alloy containing between 10% and 16% of weight of nickel on said component, and at least one layer of a tin/zinc alloy containing between 8% and 35% by weight of zinc on said sub-layer, said zinc/nickel alloy constituting about two thirds of the thickness of said coating and said tin/zinc alloy constituting about one third of the thickness of said coating.

* * * * *